US007974740B2

(12) United States Patent
Kim et al.

(10) Patent No.: US 7,974,740 B2
(45) Date of Patent: Jul. 5, 2011

(54) INTEGRATED MANAGEMENT SYSTEM AND METHOD USING SETTING INFORMATION BACK-UP FOR CONTROLLING MULTI-TYPE AIR CONDITIONERS

(75) Inventors: Jun-Tae Kim, Seoul (KR); Sang-Chul Youn, Seoul (KR); Duck-Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 889 days.

(21) Appl. No.: 11/945,492

(22) Filed: Nov. 27, 2007

(65) Prior Publication Data

US 2008/0185448 A1 Aug. 7, 2008

(30) Foreign Application Priority Data

Feb. 2, 2007 (KR) ..... 10-2007-0011211

(51) Int. Cl.

| | |
|---|---|
| ***G05B 21/00*** | (2006.01) |
| ***G05B 13/00*** | (2006.01) |
| ***G05B 15/00*** | (2006.01) |
| ***G01M 1/38*** | (2006.01) |
| ***G05D 23/00*** | (2006.01) |
| *F25B 49/00* | (2006.01) |
| *G01K 13/00* | (2006.01) |
| *F28F 27/00* | (2006.01) |

(52) U.S. Cl. ..... 700/276; 700/277; 700/278; 62/126; 62/129; 62/132; 165/200; 165/201; 165/203; 236/1 B; 236/51

(58) Field of Classification Search ..... 700/276–278; 62/126, 129, 132; 165/200–201, 203; 136/1 B, 136/51

See application file for complete search history.

(56) References Cited

U.S. PATENT DOCUMENTS

| | | | | |
|---|---|---|---|---|
| 4,174,064 | A | 11/1979 | Pratt, Jr. | |
| 4,509,679 | A | 4/1985 | Longini | |
| 5,005,365 | A | 4/1991 | Lynch | |
| 5,061,916 | A | 10/1991 | French et al. | |
| 5,435,147 | A | 7/1995 | Mochizuki et al. | |
| 5,739,760 | A | 4/1998 | Hatakeyama | |
| 6,279,332 | B1 | 8/2001 | Yeo et al. | |
| 6,453,687 | B2 | 9/2002 | Sharood et al. | |
| 6,647,317 | B2 * | 11/2003 | Takai et al. | 700/276 |
| 6,778,945 | B2 | 8/2004 | Chassin et al. | |
| 6,978,627 | B2 * | 12/2005 | Masui et al. | 62/127 |
| 7,034,710 | B2 * | 4/2006 | Falada et al. | 340/679 |

(Continued)

FOREIGN PATENT DOCUMENTS

| | | |
|---|---|---|
| CN | 1512815 | 7/2004 |

(Continued)

OTHER PUBLICATIONS

U.S. Appl. No. 11/945,482 to Kim et al, which was filed Nov. 27, 2007.

(Continued)

*Primary Examiner* — Ramesh B Patel
(74) *Attorney, Agent, or Firm* — KED & Associates LLP

(57) ABSTRACT

An integrated management system for controlling multi-type air conditioners can use a remote integrated management system to securely and automatically back up setting information for a local controller provided in at least one air conditioner system, which is disposed in a room or office and is being operated, thereby allowing an improvement of stability of the integrated management system.

12 Claims, 2 Drawing Sheets

U.S. PATENT DOCUMENTS

| | | | | |
|---|---|---|---|---|
| 7,043,339 | B2 * | 5/2006 | Maeda et al. | 700/276 |
| 7,062,927 | B2 * | 6/2006 | Kwon et al. | 62/126 |
| 7,082,353 | B2 * | 7/2006 | Kwon et al. | 700/277 |
| 7,142,112 | B2 | 11/2006 | Buckingham et al. | |
| 7,287,393 | B2 * | 10/2007 | Kwon et al. | 62/157 |
| 7,340,909 | B2 * | 3/2008 | Kwon et al. | 62/175 |
| 7,532,950 | B2 | 5/2009 | Cha et al. | |
| 7,664,573 | B2 | 2/2010 | Ahmed | |
| 7,669,433 | B2 * | 3/2010 | Yoon et al. | 62/231 |
| 7,676,300 | B2 * | 3/2010 | Kim et al. | 700/276 |
| 7,719,440 | B2 | 5/2010 | Delp et al. | |
| 7,734,572 | B2 | 6/2010 | Wiemeyer et al. | |
| 2002/0095269 | A1 * | 7/2002 | Natalini et al. | 702/188 |
| 2002/0104323 | A1 | 8/2002 | Rash et al. | |
| 2002/0120671 | A1 * | 8/2002 | Daffner et al. | 709/201 |
| 2003/0065707 | A1 * | 4/2003 | Gagner et al. | 709/201 |
| 2004/0049524 | A1 * | 3/2004 | Toyota et al. | 707/203 |
| 2004/0107717 | A1 | 6/2004 | Yoon et al. | |
| 2004/0117069 | A1 * | 6/2004 | Yoon et al. | 700/276 |
| 2004/0204793 | A1 * | 10/2004 | Yoon et al. | 700/277 |
| 2004/0255601 | A1 * | 12/2004 | Kwon et al. | 62/157 |
| 2005/0097902 | A1 * | 5/2005 | Kwon et al. | 62/126 |
| 2005/0155368 | A1 | 7/2005 | Oh et al. | |
| 2005/0204758 | A1 * | 9/2005 | Kwon et al. | 62/175 |
| 2005/0209739 | A1 | 9/2005 | Kwon et al. | |
| 2006/0162353 | A1 | 7/2006 | Ha et al. | |
| 2006/0212175 | A1 * | 9/2006 | Kim et al. | 700/277 |
| 2006/0273918 | A1 * | 12/2006 | Ram et al. | 340/679 |
| 2006/0287774 | A1 * | 12/2006 | Yoon et al. | 700/276 |
| 2007/0056298 | A1 * | 3/2007 | Baker et al. | 62/129 |
| 2007/0095084 | A1 | 5/2007 | Park et al. | |
| 2007/0113568 | A1 | 5/2007 | Jang et al. | |
| 2007/0130967 | A1 | 6/2007 | Park et al. | |
| 2007/0157644 | A1 | 7/2007 | Kim et al. | |
| 2008/0185449 | A1 * | 8/2008 | Cha et al. | 236/51 |
| 2008/0234869 | A1 * | 9/2008 | Yonezawa et al. | 700/276 |
| 2009/0139251 | A1 * | 6/2009 | Masui | 62/129 |
| 2010/0097239 | A1 | 4/2010 | Campbell et al. | |

FOREIGN PATENT DOCUMENTS

| | | | |
|---|---|---|---|
| EP | 1416346 | | 5/2004 |
| EP | 1 719 957 | | 11/2006 |
| EP | 1 429 083 | | 1/2007 |
| EP | 1804007 | | 7/2007 |
| EP | 1 703 684 | | 2/2009 |
| JP | 62-288443 | | 12/1987 |
| JP | 01-127842 | | 5/1989 |
| JP | 2002-031391 | | 1/2002 |
| JP | 2004-198102 | | 7/2004 |
| JP | 2004-265449 | | 9/2004 |
| JP | 2004-349910 | | 12/2004 |
| JP | 2005-037075 | | 2/2005 |
| JP | 2006-052928 | | 2/2006 |
| JP | 2006-337021 | | 12/2006 |
| KR | 2001-0077589 | | 8/2001 |
| KR | 2002-0048333 | | 6/2002 |
| KR | 2003-0035399 | | 5/2003 |
| KR | 10-2004-0032648 | | 4/2004 |
| KR | 10-0613509 | B1 | 8/2006 |
| KR | 10-0649599 | | 11/2006 |
| KR | 10-0697079 | B1 | 3/2007 |

OTHER PUBLICATIONS

English language Abstract of KR 10-2005-0094259 A.
English language Abstract of KR 10-2006-0100182 A.
Machine Translation of JP 2004-349910.
Machine Translation of JP 2005-037075.
Machine Translation of KR10-2003-0035399 can be found in U.S. Patent No. 7,676,300.
Machine Translation of KR10-2004-0032648 can be found in U.S. Patent No. 7,676,300.
"A closer look on today's home and building networks," W. Kastner, P. Palensky, T. Rausch, Ch. Roesener; AFRICON, 2004, 7th, AFRICON conference in Africa Gaborone, Botswana Sep. 15-17, 2004, Piscataway, NJ, USA, IEEE, vol. 2, Sep. 15, 2004, pp. 1239-1245, XP010780666 ISBN:0-7803-8605-1.
Chinese Office Action dated Nov. 6, 2009 in Patent Application No. 200810003123.5.

* cited by examiner

INTEGRATED MANAGEMENT SYSTEM AND METHOD USING SETTING INFORMATION BACK-UP FOR CONTROLLING MULTI-TYPE AIR CONDITIONERS

BACKGROUND OF THE INVENTION

1. Field of the Invention

The present invention relates to an integrated management system and method for controlling multi-type air conditioners, and more particularly, to an integrated management system and method for controlling multi-type air conditioners capable of stably controlling an operation of at least one air conditioner group by backing up setting information used as criteria for controlling the operation of the at least one air conditioner group.

2. Background of the Invention

Air conditioner systems are now used in most buildings and homes. For example, one type of air conditioner system includes indoor units disposed in each room of a home or in each office in a building, and an outdoor unit shared by and connected to the indoor units.

An air conditioner group denotes a grouping of a plurality of air conditioners, and an air conditioner system denotes a system for managing at least one air conditioner group.

The air conditioner system may include a local controller which detects various operation states of the plurality of air conditioner groups and controls the plurality of air conditioner groups via a gateway according to the detection.

An integrated management system for controlling the multi-type air conditioners is being developed to integrally manage at least one air conditioner system from a remote location.

The integrated management system for controlling the multi-type air conditioners may collect operation state information related to the air conditioner system having the multi-type air conditioners and setting information related to the local controller for the multi-type air conditioners, so as to store and manage such information in a database. Thus, when the air conditioner system is not working properly, the integrated management system can automatically detect the malfunction or error and rapidly repair it.

Here, the local controller may include setting information related to indoor units and outdoor units and various types of setting information (e.g., scheduling information, malfunction history data, user information, etc.). Such setting information are considered to be very important and should be protected.

In the operation of the related art integrated management system for controlling the multi-type air conditioners, the setting information can be protected as a user directly backs up (or stores) the setting information in a storage unit, or the setting information is automatically backed up (or stored) in a storage unit of a local controller in a periodic manner using a backup software program.

Such setting information may be backed up automatically. However, when an error occurs in the setting information, the error in the setting information should be manually repaired by the user.

Furthermore, when changes do not occur in the setting information, the operation of backing up the setting information in the storage unit of the local controller undesirably increases the processing load of the local controller.

SUMMARY OF THE INVENTION

The present inventors recognized at least the above described problems of the related art. Based upon such recognition, it is an object of the present invention to provide an integrated management system and method for controlling multi-type air conditioners capable of stably backing up setting information related to a local controller of at least one air conditioner system which is disposed in a particular area (e.g., room or office) and is being operated, and then remotely controlling the backup setting information for restoration when an error occurs in the setting information.

To achieve, in one aspect of the present invention, there is provided an integrated management system for controlling multi-type air conditioners in accordance with one embodiment of the present invention comprising: at least one air conditioner system including at least one air conditioner group provided with a local controller connected to multi-type air conditioners via a gateway, and configured to monitor changes in setting information related to the at least one air conditioner group and convert the setting information based on the monitored result into setting information data according to a remote communication protocol so as to transmit the setting information data.

In another aspect of the present invention, there is provided an integrated management system for controlling multi-type air conditioners comprising: a remote integrated management system configured to receive and store setting information data for back-up based on a remote communication protocol from at least one air conditioner system, and convert and transmit the stored setting information data for back-up according to the remote communication protocol when a restoration is requested.

In another aspect of the present invention, there is provided an integrated management system for controlling multi-type air conditioners comprising: at least one air conditioner system including at least one air conditioner group provided with a local controller connected to multi-type air conditioners via a gateway, and configured to monitor changes in setting information related to the at least one air conditioner group and convert the setting information based on the monitored result into setting information data for back-up according to a remote communication protocol so as to transmit the setting information data for back-up; and a remote integrated management system configured to receive and store the setting information data for back-up based on the remote communication protocol from the at least one air conditioner system, and convert and transmit the stored setting information data for back-up according to the remote communication protocol when a restoration is requested.

Here, the at least one air conditioner system comprises a backup/restoring module configured to monitor the change in the setting information, such that when it is monitored that the setting information changed, the backup/restoring module converts the changed setting information into setting information data for back-up according to the remote communication protocol for transmission.

The remote integrated management system comprises: a remote data-for-backup collecting module configured to receive the setting information data for back-up based on the remote communication protocol from the at least one air conditioner system; a database server configured to classify the received setting information data for backup for each air conditioner group and store the classified data; and a remote data-for-restoration transmitting module configured to convert the setting information data for back-up stored in the database server into setting information data for restoration based on the remote communication protocol for transmission.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to some embodiments of the present invention, examples of which are illustrated in the accompanying drawings.

Figure 1:
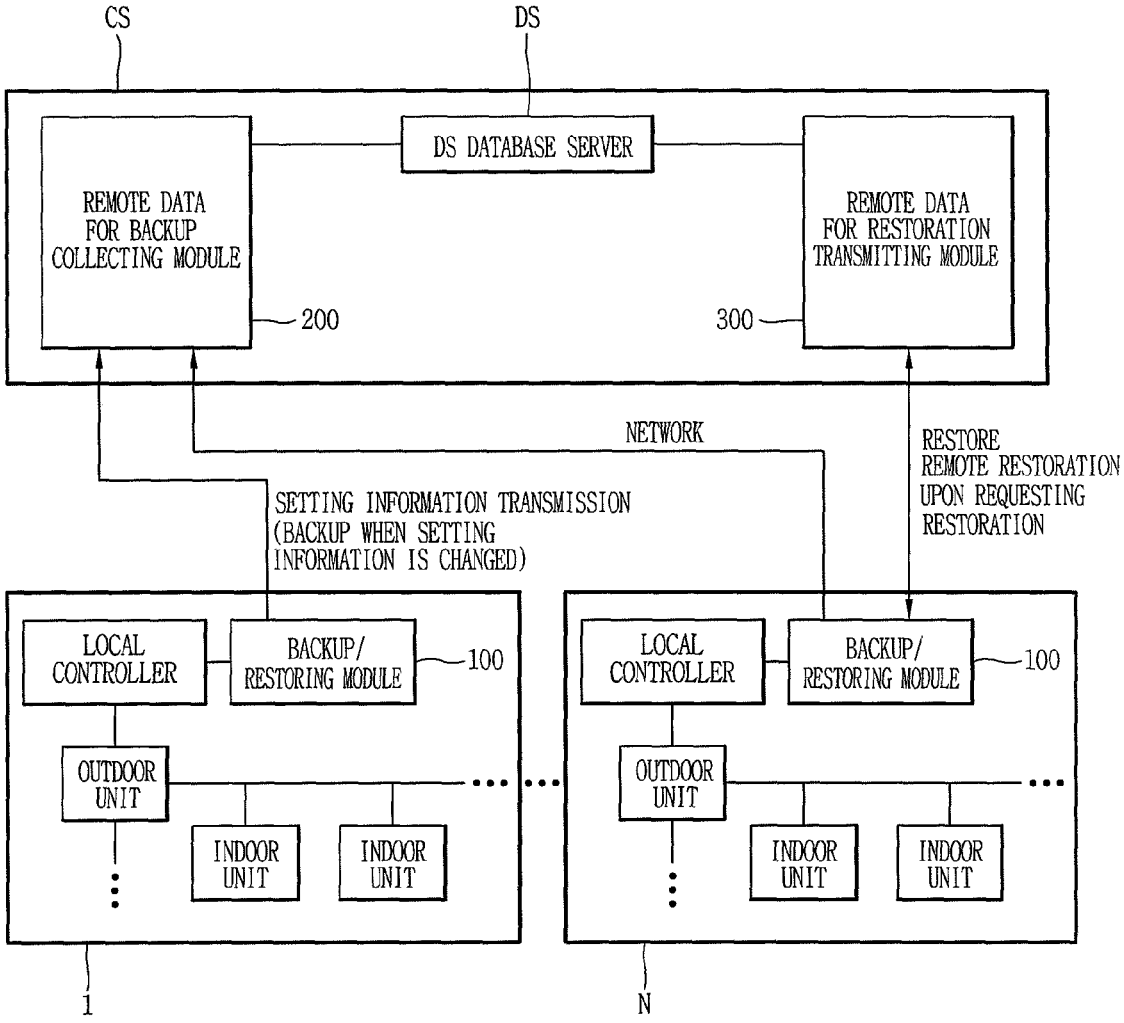
FIG. 1 is a block diagram illustrating an integrated management system for controlling multi-type air conditioners in accordance with one embodiment of the present invention.

FIG. 1 is a block diagram illustrating an integrated management system for controlling multi-type air conditioners in accordance with one embodiment of the present invention.

As illustrated in FIG. 1, an integrated management system may comprise a plurality of air conditioner systems (1 to N), and a remote integrated management system (CS).

Each air conditioner system (1 to N) detects changes in each setting information related to one or more air conditioner groups, and converts the detected setting information into setting information data according to a remote communication protocol, to thusly transmit the converted setting information data.

Here, the air conditioner group denotes an air conditioner installation arrangement including a plurality of air conditioners capable of satisfying the cooling requirements of a building, whereby at least one indoor unit is connected to one outdoor unit. It is possible not only to separately control each air conditioner using an indoor unit disposed in each room or location, but also, to integrally control every air conditioner in a building at a certain location by means of a local controller (or some other type of control entity).

Here, the air conditioner systems (1 to N) according to the present invention may include a backup/restoring module (100) (or some other type of entity or entities that perform data back-up and/or restoring functions) configured to detect any changes in the setting information, such that when it is found that the setting information is changed, the backup/restoring module (100) converts the changed setting information into setting information data for back-up according to a remote communication protocol, to thusly transmit the data.

The remote integrated management system (CS) then receives and stores the setting information data for back-up based on the remote communication protocol from the one or more air conditioner systems (1 to N). When receiving a restoration request, the remote integrated management system (CS) converts the stored setting information data for back-up according to the remote communication protocol for transmission.

The remote integrated management system (CS) may include a remote data-for-backup collecting module (200) (or some other type of entity that collects certain data for storage) configured to receive the setting information data for back-up based on the remote communication protocol from the one or more air conditioner systems (1 to N), a database server (DS) (or some other type of network entity) configured to classify and store the received setting information data for back-up for each air conditioner group, and a remote data-for-restoration transmitting module (300) (or some other type of entity that transmits certain data for restoration) configured to convert the setting information data stored in the database server (DS) into setting information data for restoration based on the remote communication protocol when restoration is requested.

Also, the remote integrated management system (CS) may further include a monitoring server (not shown) (or some other type of network entity) configured to display operation state information on the air conditioner systems (1 to N) that a service manager (or operator) wants to know.

Figure 2:
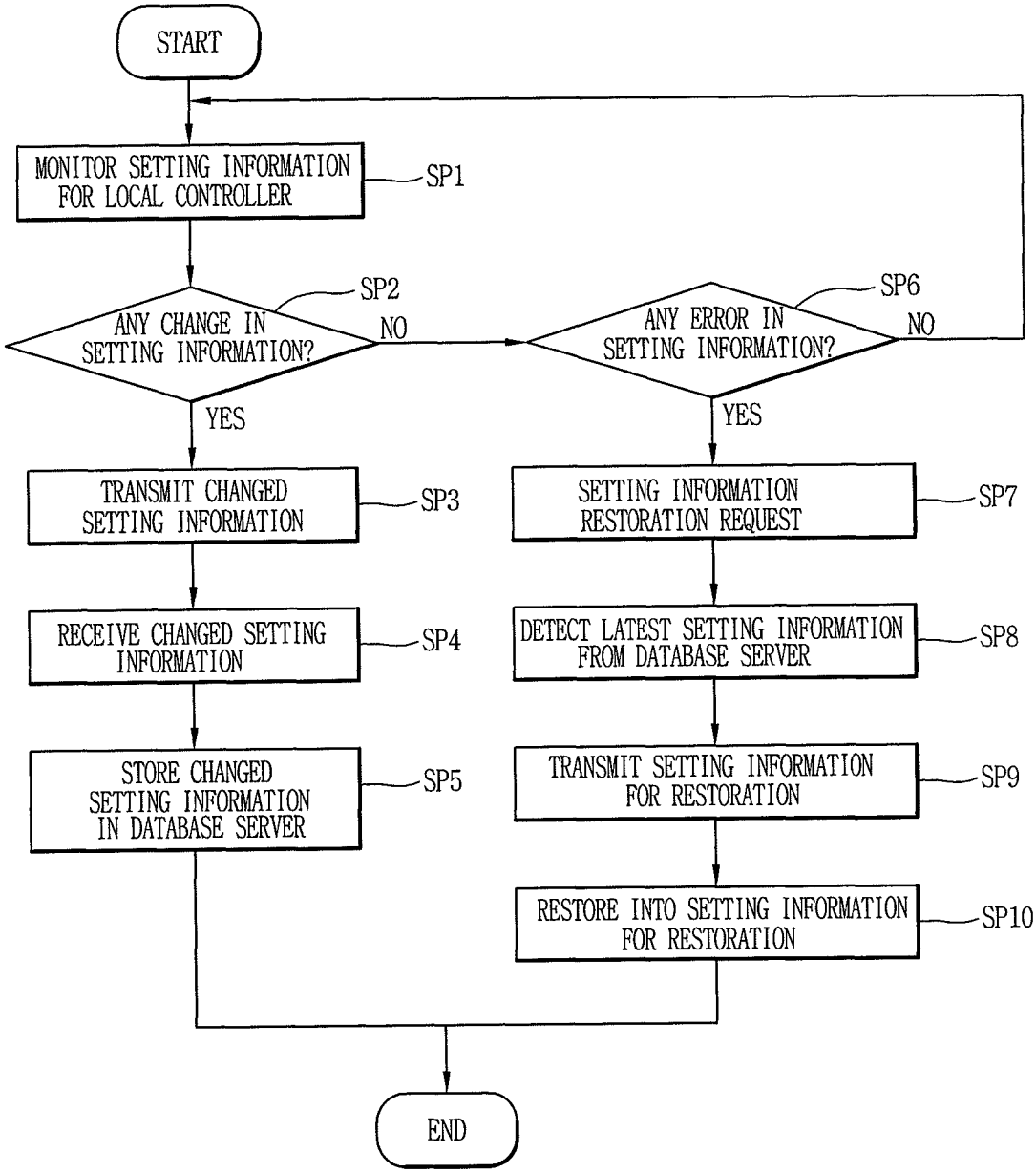
FIG. 2 is a flowchart illustrating an operation of an integrated management system for controlling multi-type air conditioners in accordance with the present invention.

An exemplary operation of the remote management system for controlling the multi-type air conditioners according to the present invention having such configuration will now be described with reference to FIG. 2.

First, according to the present invention, the backup/restoring module (100) is pre-set to perform back up (or storing) of setting information that has changed or to request a restoration procedure for correcting an error occurred in the setting information when the change or error is detected in the setting information while monitoring changes or errors in the setting information for the local controller.

Here, the local controller of the air conditioner systems (1 to N) controls and monitors multi-type air conditioners connected thereto using various types of setting information.

For example, the local controller recognizes, based on the setting information, schedule information required for performing schedule control, power usage information for performing power control, malfunction history information with respect to any malfunctions that occurred, user information and the like, as well as the names, positions (locations), model type and connection information all related to the indoor units and the outdoor unit. The local controller then controls the multi-type air conditioners connected thereto based upon the recognized results.

Here, the present invention will be described in an example of cooperation between one air conditioner system (1 to N) and the remote integrated management system (CS).

First, the backup/restoring module (100) of the air conditioner system (1 to N) monitors any changes in the setting information related to the local controller (SP1).

While monitoring the setting information related to the local controller, if any change occurs in the setting information (SP2), the backup/restoring module (100) sends the changed setting information to the remote data-for-backup collecting module (200) of the remote integrated management system CS (SP3).

Accordingly, the remote data-for-backup collecting module (200) receives the changed setting information from the backup/restoring module (100) (SP4), and then stores the received changed setting information in the database server (DS) (SP5).

Also, the backup/restoring module (100) monitors the change in the setting information related to the local controller, and simultaneously determines whether any error occur in the setting information (SP6).

According to the determination, if an error has occurred in the setting information related to the local controller, the backup/restoring module (100) sends a setting information restoration request signal to the remote data-for-restoration transmitting module (300) of the remote integrated management system (CS) (SP7).

Thereafter, the remote data-for-restoration transmitting module (300) of the remote integrated management system (CS) detects the latest (i.e., most recent) setting information from the database server (DS) (SP8), and sends the detected latest setting information to the backup/restoring module (100) of the air conditioner system (1 to N) (SP9).

The backup/restoring module (100) of the air conditioner system (1 to N) accordingly restores the setting information related to the local controller into the latest setting information received from the remote data-for-restoration transmitting module (300) of the remote integrated management system (CS) (SP10).

That is, in the present invention, while the backup/restoring module of the local controller disposed in the air conditioner system monitors whether changes or errors occur in the setting information on the multi-type air conditioners, if any change occurs in the setting information, the backup/restoring module sends the changed setting information to the remote integrated management system. The remote integrated management system then backs up (or stores) and manages the setting information. If any error is detected in the setting information, the backup/restoring module restores the setting information for the local controller in the air conditioner system using the setting information backed up in the remote integrated management system.

The integrated management system of the present invention can be applied to a system having multi-type air conditioners, to a single air conditioner, and to components included in each air conditioner.

In other words, the embodiments of the present invention have been described in detail with reference to the drawings; however, they should not be construed as limiting the scope of the present invention. Also, it can be understood by those skilled in the art that many variations can be implemented within the scope as defined in the appended claims.

As described above, the integrated management system for controlling multi-type air conditioners according to the present invention can use the remote integrated management system to securely and automatically back up (or store) setting information related to a local controller disposed in at least one air conditioner system, which is installed at a certain location (i.e., in a room/office) and is being operated, thereby allowing an improvement of stability of the integrated management system.

Also, by using the integrated management system for controlling multi-type air conditioners according to the present invention, when an error occurs in the setting information for the local controller disposed in the air conditioner system, various errors can rapidly be restored (or fixed) by an automated restoring function, thereby allowing an improvement of stability of the integrated management system.

The features described herein are related to an integrated management system (CS) for controlling multi-type air conditioners, the system comprising: a data collecting unit (200) to communicate with at least one multiple air conditioning system (1 to N) in order to collect data related to any changes or updates in operation setting information; a data transmitting unit (300) to communicate with the at least one multiple air conditioning system (1 to N) in order to transmit data related to data back-up or data restoration; and a storage medium (DS) connected with the data collecting unit (200) and the data transmitting unit (300), whereby changed or updated operation setting information is stored in the storage medium (DS) to be used for data back-up or data restoration.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An integrated management system for controlling a plurality of air conditioners, the integrated management system comprising:

at least one air conditioner system including at least one air conditioner group provided with a local controller connected to a plurality of air conditioners of the at least one air conditioner group via a gateway, and configured to monitor changes in setting information related to the at least one air conditioner group, convert the setting information based on the monitored changes into setting information data according to a remote communication protocol to transmit the setting information data, and restore the setting information related to the local controller when an error occurs in the setting information.

2. The integrated management system of claim 1, wherein the at least one air conditioner system comprises:

a backup and restoring module configured to monitor the changes in the setting information, wherein when the setting information is changed, the backup and restoring module converts the changed setting information into setting information data for back-up according to the remote communication protocol for transmission.

3. The integrated management system of claim 2, wherein the backup and restoring module transmits a request signal for restoring the setting information when the error occurs in the setting information, and restores the setting information related to the local controller into setting information for back-up as a response signal with respect to the request signal.

4. A system for controlling a plurality of air conditioners, the system comprising:

a remote integrated management system configured to receive setting information data from at least one air conditioner system including at least one air conditioner group and store the setting information data for back-up, based on a remote communication protocol, and to convert and transmit the stored setting information data for back-up according to the remote communication protocol when a restoration is requested.

5. The system of claim 4, wherein the remote integrated management system comprises:

a data collecting module configured to receive the setting information data for back-up based on the remote communication protocol from the at least one air conditioner system;

a network entity configured to classify the received setting information data for back-up for each at least one air conditioner group and store the classified data; and a data transmitting module configured to convert the setting information data for back-up stored in the network entity into setting information data for restoration based on the remote communication protocol for transmission.

6. An integrated management system for controlling a plurality of air conditioners, the system comprising:

at least one air conditioner system including at least one air conditioner group provided with a local controller connected to a plurality of air conditioners of the at least one air conditioner group via a gateway, and configured to monitor changes in setting information related to the at least one air conditioner group and convert the setting information based on the monitored changes into setting information data for back-up according to a remote communication protocol to transmit the setting information data; and a remote integrated management system configured to receive and store the setting information data for back-up based on the remote communication protocol from the at least one air conditioner system, and convert and transmit the stored setting information data for back-up according to the remote communication protocol when a restoration is requested.

7. The integrated management system of claim 6, wherein the at least one air conditioner system comprises:

a backup and restoring module configured to monitor the changes in the setting information, wherein when the backup and restoring module monitors that the setting information is changed, the backup and restoring module converts the changed setting information into the setting information data for back-up according to the remote communication protocol for transmission.

8. The integrated management system of claim 7, wherein the backup and restoring module transmits a request signal to restore the setting information when an error occurs in the setting information, and restores the setting information related to the local controller into the setting information data for back-up as a response signal with respect to the request signal.

9. The integrated management system of claim 6, wherein the remote integrated management system comprises:

a data-for-backup collecting module configured to receive the setting information data for back-up based on the remote communication protocol from the at least one air conditioner system;

a database server configured to classify the received setting information data for back-up for each of the at least one air conditioner group and store the classified data; and a remote data-for-restoration transmitting module configured to convert the setting information data for back-up stored in the database server into setting information data for a restoration based on the remote communication protocol for transmission.

10. An integrated management method for controlling a plurality of air conditioners, the method comprising:

monitoring setting information related to a local controller;

transmitting the setting information when any change is found in the monitored setting information;

receiving the transmitted setting information and storing the setting information as setting information for back-up;

requesting a restoration of the setting information when an error occurs in the monitored setting information related to the local controller; and receiving the stored setting information as the setting information for back-up and restoring the setting information for the local controller into the received setting information for back-up.

11. An integrated management method for controlling a plurality of air conditioners, the method comprising:

monitoring setting information of a local controller;

requesting a restoration of the setting information when an error occurs in the monitored setting information;

detecting most recently stored setting information according to the restoration request, and transmitting the detected setting information as setting information for restoration; and receiving the restoration setting information, and restoring the setting information for the local controller into the received setting information for restoration.

12. An integrated management system for controlling a plurality of air conditioners, the integrated management system comprising:

a data collecting device that communicates with at least one air conditioning system including at least one air conditioner group in order to collect data related to any changes or updates in operation setting information;

a data transmitting device that communicates with the at least one air conditioning system in order to transmit data related to data back-up or data restoration; and a storage medium connected with the data collecting device and the data transmitting device, wherein the changed or updated operation setting information is stored in the storage medium to be used for data back-up or data restoration.

* * * * *